US007504574B2

(12) United States Patent
Okamoto et al.

(10) Patent No.: US 7,504,574 B2
(45) Date of Patent: Mar. 17, 2009

(54) ELECTRONIC MUSICAL INSTRUMENT AND WAVEFORM ASSIGNMENT PROGRAM

(75) Inventors: Tetsuo Okamoto, Hamamatsu (JP); Takeshi Komano, Iwata (JP)

(73) Assignee: Yamaha Corporation, Hamamatsu-Shi (JP)

( * ) Notice: Subject to any disclaimer, the term of this patent is extended or adjusted under 35 U.S.C. 154(b) by 0 days.

(21) Appl. No.: 12/122,065

(22) Filed: May 16, 2008

(65) Prior Publication Data

US 2008/0216636 A1 Sep. 11, 2008

Related U.S. Application Data

(63) Continuation of application No. 11/360,560, filed on Feb. 22, 2006.

(30) Foreign Application Priority Data

Mar. 17, 2005 (JP) ..... 2005-076392

(51) Int. Cl.
*G10H 1/02* (2006.01)
*G10H 7/02* (2006.01)

(52) U.S. Cl. ..... 84/615; 84/604

(58) Field of Classification Search ..... 84/604, 84/615

See application file for complete search history.

(56) References Cited

U.S. PATENT DOCUMENTS 4,862,784 A * 9/1989 Kimpara ..... 84/622
4,957,032 A 9/1990 Hirano et al.
5,105,709 A * 4/1992 Suzuki ..... 84/615
5,198,605 A * 3/1993 Konishi ..... 84/658
5,451,710 A * 9/1995 Shimizu ..... 84/622
5,496,963 A * 3/1996 Ito ..... 84/653
5,652,402 A * 7/1997 Kondo et al. ..... 84/653
5,686,682 A 11/1997 Ohshima et al.
5,908,997 A 6/1999 Arnold et al.

OTHER PUBLICATIONS

Yamaha Portatone PSR, 6000, Owner's Manual, pp. 12-17.
Ludwig Carlson, et al., "Propellerhead Reason Version 2.5 Operation Manual," pp. 55, 152, 156, 158-159, and 161-168.

* cited by examiner

*Primary Examiner*—Walter Benson
*Assistant Examiner*—Andrew R Millikin
(74) *Attorney, Agent, or Firm*—Morrison & Foerster LLP

(57) ABSTRACT

An electronic musical instrument, which can easily select waveform data assigned to each key or each key range of a keyboard, is provided. When assignment of waveform data to a key range including one or more keys of a keyboard is edited, the assignment state of the waveform data is displayed, and a mode setting operation of an operating unit is allowed in response to display of the assignment state of the waveform data. Waveform selection mode is set in response to operation of the operating unit by the user. When a key of the keyboard is operated in waveform selection mode, waveform data assigned to the operated key is selected, and an assignment state of the selected waveform data is allowed to be editable.

5 Claims, 4 Drawing Sheets

ELECTRONIC MUSICAL INSTRUMENT AND WAVEFORM ASSIGNMENT PROGRAM

CROSS-REFERENCE TO RELATED APPLICATIONS

This application is a continuation of U.S. patent application Ser. No. 11/360,560 filed Feb. 22, 2006, the entire disclosures of which is incorporated herein by reference.

BACKGROUND OF THE INVENTION

1. Field of the Invention

The present invention relates to an electronic musical instrument wherein a plurality of waveform data for controlling musical waveforms, which has been assigned to a plurality of keys of a keyboard, can be set to different keys.

2. Description of the Related Art

In some known electronic musical instruments (for example, one described in Japanese Patent Application Publication No. 8-83075 and corresponding U.S. Pat. No. 5,686,682), waveform data, which has been input through a microphone or the like and then recorded, or waveform data, which has previously been stored in a recording medium, is assigned to each key or each range of keys of a keyboard.

In such conventional electronic musical instruments, it is necessary for the user to select target waveform data when performing waveform data editing to change an assignment state of the waveform data or to delete the assigned waveform data. However, it is very difficult for the user to select the target waveform data when various types of waveforms have been assigned to keys or key ranges.

The keyboard of the electronic musical instrument includes a number of keys (for example, 61 keys). When different waveform data (for example, a different drum tone) has been assigned to each key, there are the same large number of options of the waveform data as that of the keys so that it is difficult to find target waveform data.

It is also difficult to intuitively determine the relationship between keys and displayed options when waveform data is assigned to keys or key ranges. For example, even when "C2-C3" is displayed as an option of waveform data assigned to a key range of C2-C3, it is difficult for the user to directly determine which key corresponds to the option.

SUMMARY OF THE INVENTION

Therefore, the present invention has been made in view of the above problems, and it is an object of the present invention to provide an electronic musical instrument which can easily select waveform data assigned to each key or each key range of a keyboard.

In accordance with one aspect of the present invention, the above and other objects can be accomplished by the provision of an electronic musical instrument (specifically, a computer with music software) comprising a keyboard (14) including a plurality of keys (C1-C6); display section (16; We; S0) for displaying an assignment state (Aw) of waveform data in which the waveform data is assigned to the keyboard (14); an operating section (DRw; S0) for allowing a mode setting operation in correspondence to display of the assignment state (Aw) of the waveform data; a mode setting section (Se1) for setting a waveform direct selection mode in response to the mode setting operation of the operating section (DRw; S0); and a waveform selection section (S10) for selecting waveform data assigned to a key of the keyboard (14) as an assignment editing target, in response to the direct operation of the key of the keyboard (14) in the waveform direct selection mode, and allowing an assignment state of the selected waveform data to be editable.

In accordance with another aspect of the present invention, there is provided a waveform assignment program which allows a computer comprising an operating section (DRw; S0) and a keyboard (14) having a plurality of keys (C1-C6) to perform the steps of displaying an assignment state (Aw) of waveform data in which the waveform data is assigned to the keyboard (14) (Display Step (S0)); allowing a mode setting operation of the operating section (DRw; S0) in correspondence to display of the assignment state (Aw) of the waveform data (Operation Step (S0)); setting a waveform direct selection mode in response to the mode setting operation of the operating section (DRw; S0) (Mode Setting Step (S4)); and selecting waveform data assigned to a key of the keyboard (14) as an assignment editing target (Se1), in response to direct operation of the key of the keyboard (14) in the waveform selection mode, and allowing an assignment state of the selected waveform data to be editable (Waveform Selection Step (S10)). The symbols in parentheses provided for better understanding correspond to reference symbols in the embodiments of the present invention described later.

In the electronic musical instrument according to the present invention, the assignment state (Aw) of the waveform data displayed by the display section (16; We; S0) preferably includes waveform name information indicating the waveform data and key range information indicating a key range to which the waveform data is assigned.

In the electronic musical instrument (specifically, a computer with music software), when the assignment of the waveform data to a key range including one or more keys of the keyboard (14) is edited, the assignment state (Aw) of the waveform data is displayed, and a mode setting operation of the operating section (DRw) is allowed in response to the display of the assignment state (Aw) of the waveform data (S0). Waveform direct selection mode is set in response to the mode setting operation of the operating section (DRw) by a user (S4). When a key of the keyboard (14) is operated in the waveform selection mode, waveform data assigned to the operated key of the keyboard (14) is selected (Se1), and an assignment state of the selected waveform data is allowed to be editable (S10).

According to the present invention, if a key of the keyboard is operated in the waveform direct selection mode, waveform data assigned to the operated key is selected, so that target waveform data assigned to each key of the keyboard can be easily selected as an assignment editing target. In addition to easy operation to select a waveform assigned to the keyboard, it is possible to perform editing of the assignment state of the currently selected waveform data, such as modification of the assignment state or removal thereof from allocation targets.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

[Overview of the System]

Figure 1:
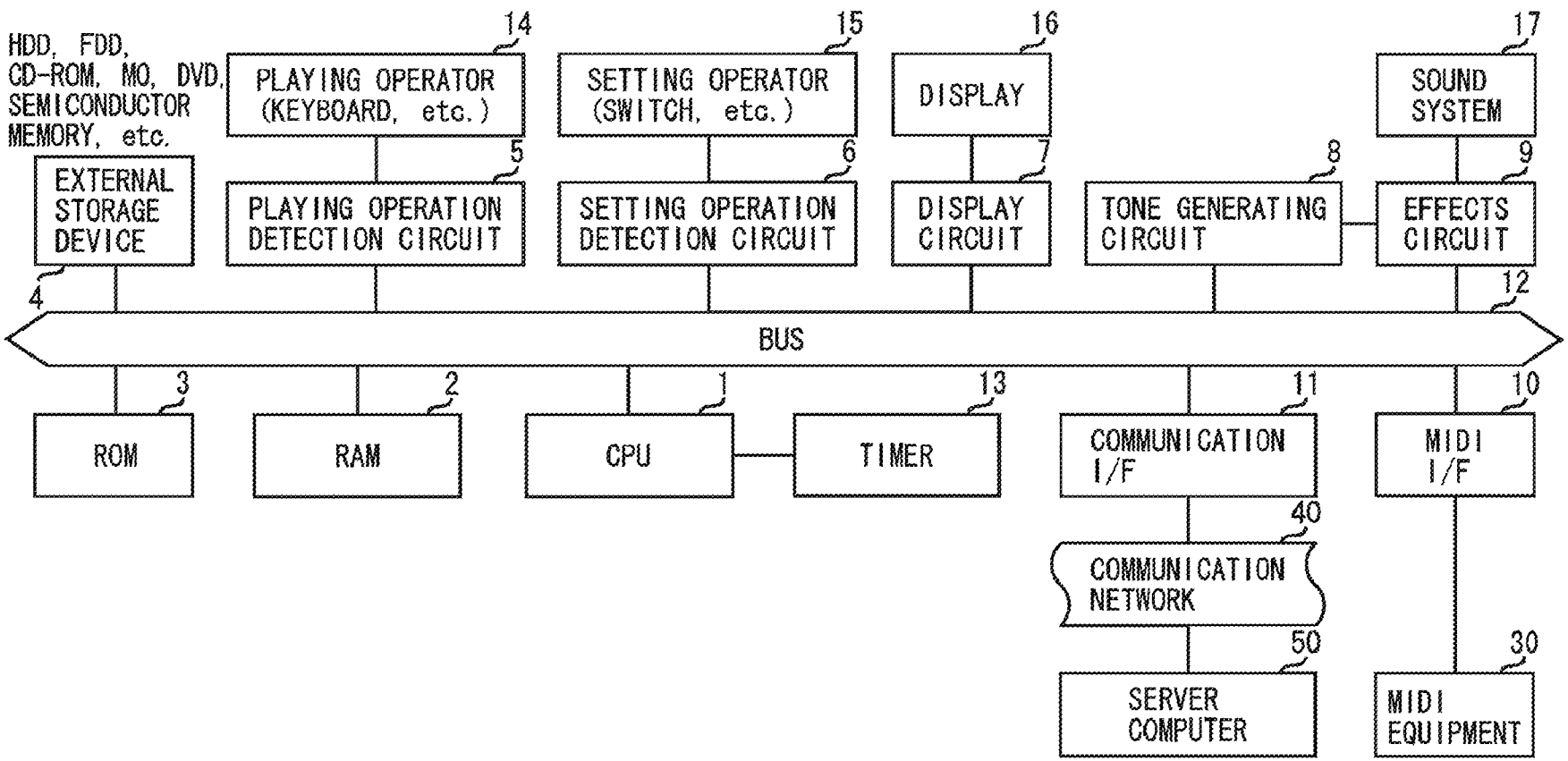
FIG. 1 is a hardware block diagram of an electronic musical instrument according to an embodiment of the present invention.

FIG. 1 is a hardware block diagram of an electronic musical instrument according to an embodiment of the present invention. This electronic musical instrument is a type of computer having a function to process musical information, and comprises a Central Processing Unit (CPU) 1, a Random Access Memory (RAM) 2, a Read Only Memory (ROM) 3, an external storage device 4, a playing operation detection circuit 5, a setting operation detection circuit 6, a display circuit 7, a tone generating circuit 8, an effects circuit 9, a MIDI interface (I/F) 10, and a communication interface (I/F) 11. These elements 1 to 11 are connected to each other via a bus 12.

The CPU 1 performs a variety of processes for musical information, including a waveform assignment process, using a clock from a timer 13 according to a specific control program. The RAM 2 is used as a work area for temporally storing a variety of data necessary during these processes. The ROM 3 is a machine readable medium and previously stores a variety of control programs including the waveform assignment program, preset waveform data, or the like in order to perform the processing.

In addition to a built-in storage medium such as a hard disk (HD) or a flash memory (a semiconductor memory), the external storage device 4 may include a variety of portable external storage media such as a Compact Disc Read Only Memory (CD-ROM), a flexible disk (FD), a Magneto-Optical (MO) disk, a Digital Versatile Disc (DVD), and a small-size memory card such as Smart Media™. Any data can be stored in any external storage device 4. For example, newly obtained waveform data or voice (tone) data can be stored in an arbitrary storage medium and then be used for waveform assignment or automatic playing.

The playing operation detection circuit 5 detects operations of a playing operator 14 such as a keyboard, and the setting operation detection circuit 7 detects operations of a setting operator (or a panel operator) 15 such as switches (also referred to as buttons) or a mouse. The detection circuits 5 and 7 provide information corresponding to the detected operations to a system body. The display circuit 7 includes a variety of indicators or a display device 16 such as an LCD for displaying a variety of screens. The display circuit 7 controls display information for the display device 16 or the variety of indicators according to commands from the CPU 1, and provides display support for operations of the operators 14 and 15. For example, when a waveform editing process is performed, a waveform editing screen (We) is displayed on the display 6, and specific functions are assigned to switches 15 provided around the display device 16, so that a waveform editing work to change waveform data assigned to each key of the keyboard or to remove the waveform data can be performed according to the user's operation.

The tone generating circuit 8 includes a waveform data memory for storing required waveform data from among waveform data stored in the ROM 3 or the external storage device 4, and the effects circuit 9 includes an effects DSP. Each of the tone generating circuit 8 and the effects circuit 9 may incorporate software. The two circuits 8 and 9 constitute a musical signal generator. In response to operation of a key of the keyboard 14, the musical signal generator generates a musical signal which has a waveform based on waveform data assigned to the operated key via the waveform assignment process and to which specific effects have been imparted. The musical signal generator 8 and 9 can also generate musical signals based on playing data from the storage units 3 and 4. A sound system 17 provided subsequent to the musical signal generator 8 and 9 includes a D/A converter, an amplifier and a speaker, and generates a musical sound based on musical signals from the effects circuit 9.

MIDI music equipment 30 is connected to the MIDI interface 10, through which MIDI playing data is exchanged with the music equipment 30 so that the music equipment 30 can be used with this electronic musical instrument. A communication network 40 such as the Internet or a Local Area Network (LAN) is connected to the communication interface 11, through which a control program or a variety of data can be received from an external server computer 50 or the like and then be saved in the external storage device 4.

[Overview of Waveform Assignment]

Figure 2:
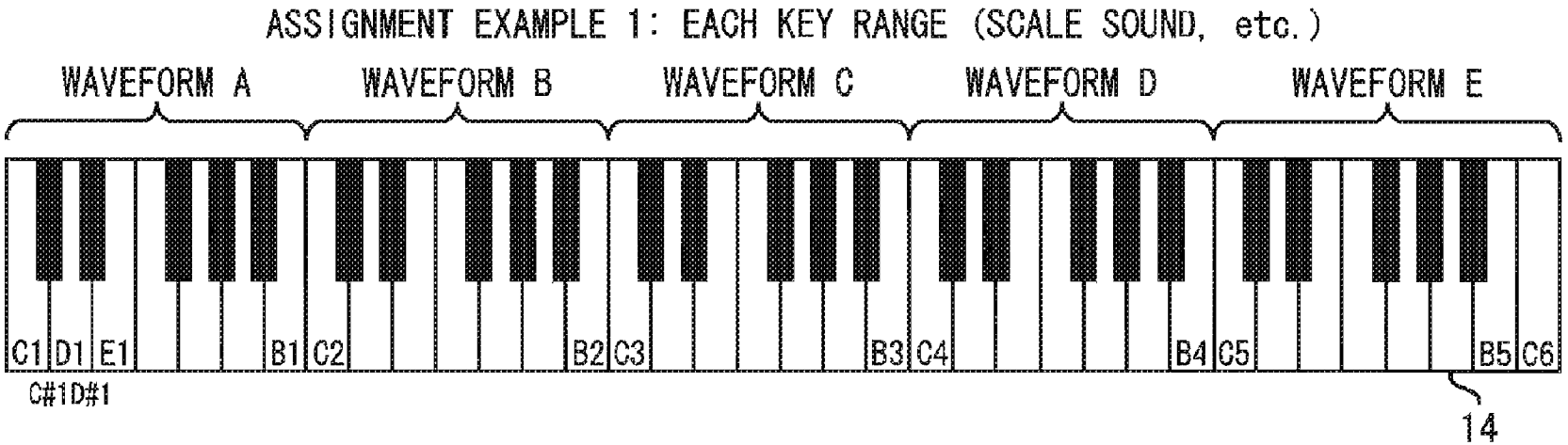
FIGS. 2(*a*) and 2(*b*) illustrate an example of assignment of waveform data in an electronic musical instrument according to an embodiment of the present invention.
Figure 2:
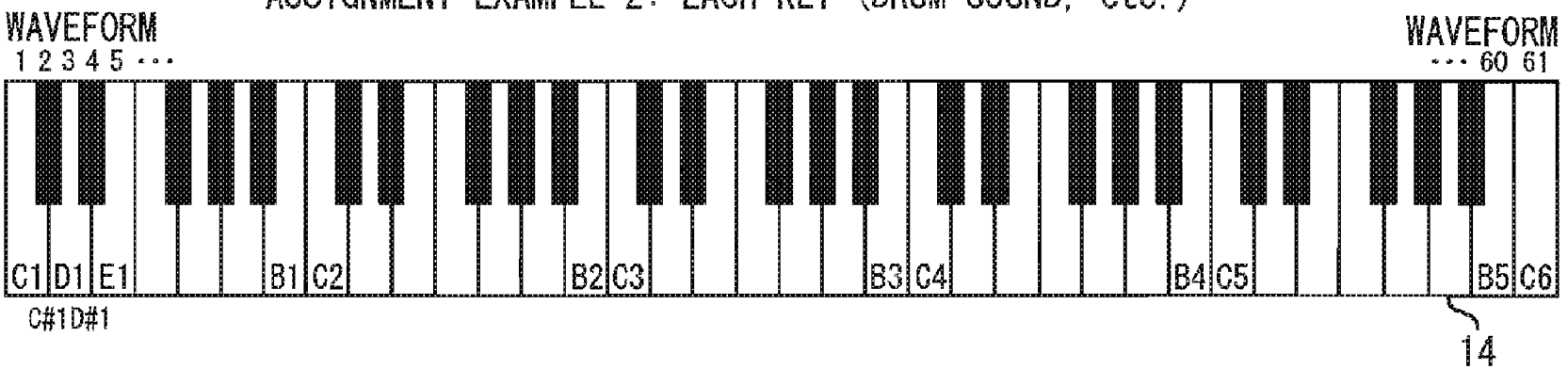

Waveform data is assigned to a key range including one or more keys in an embodiment of the present invention. FIGS. 2(*a*) and 2(*b*) show examples of the waveform data assignment in the electronic musical instrument according to the embodiment of the present invention. In FIGS. 2(*a*) and 2(*b*), symbols C1, C#1, D1, . . . , appended to keys represent pitches of the keys. In the shown example, the keyboard 14 of the electronic musical instrument includes 61 keys C1-C6.

FIG. 2(*a*) shows an example (Assignment Example 1) of the assignment of waveform data such as a scale sound in which specific waveform data identified by names (waveform name information) "waveform A", "waveform B", . . . , and "waveform E" are assigned to key ranges C1-B1, C2-B2, . . . , and C5-C6, respectively. Although each key range is about one octave wide in this example, it may be wider or narrower than one octave. The pitch width of each key range may also differ from each other.

FIG. 2(*b*) shows another example (Assignment Example 2) of the assignment of waveform data such as a drum sound in which specific waveform data identified by names (waveform name information) "waveform 1", "waveform 2", "waveform 3", "waveform 4", "waveform 5", . . . , "waveform 60", and "waveform 61" are assigned to the keys C1, C#1, D1, D#1, E1, . . . , B5, and C6, respectively.

Figure 3:
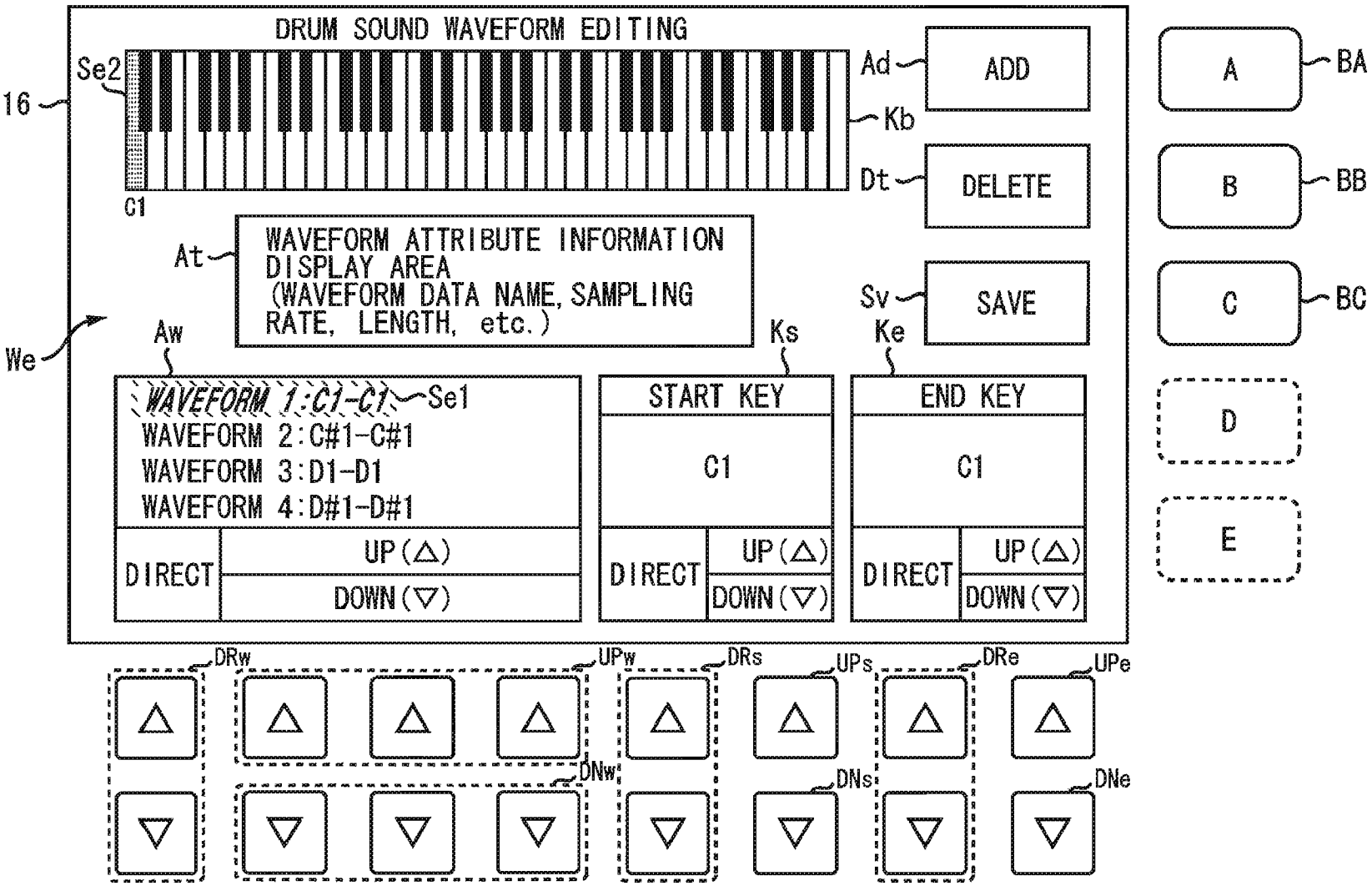
FIG. 3 illustrates an example of a waveform editing screen and button functions in an electronic musical instrument according to an embodiment of the present invention.

FIG. 3 shows an example of a waveform editing screen We displayed on the display device 16 and an example of the assignment of input functions to corresponding switches of the setting operator 15 when editing is performed to assign waveform data to the keys or key ranges of the keyboard 14. This waveform editing screen We is an example screen displayed during drum waveform editing in which waveform data is assigned to each key as shown in FIG. 2(*b*). Here, it is assumed that waveform data "waveform 1" to "waveform 61" are previously assigned to the 61 keys C1-C6 as shown in FIG. 2(*b*).

A keyboard figure (image) Kb representing the keyboard 14 of the electronic musical instrument is displayed on the waveform editing screen We at an upper portion thereof. An add operation guide image Ad indicating addition of a waveform, a delete operation guide image Dt indicating deletion of a waveform, and a save operation guide image Sv indicating saving of setting states are displayed on the screen We along a right portion thereof. In addition, a waveform attribute information display area At is provided below the keyboard image Kb, and a waveform assignment guide area Aw, a start key guide area Ks, and an end key guide area Ke are provided along a lower portion of the screen We.

The waveform assignment guide area Aw includes an upper waveform assignment display portion and a lower waveform selection guide portion. Waveform assignment information, which includes information of waveform names indicating waveform data and information of key ranges set for the waveform data, is displayed on the waveform assignment display portion, and a currently selected waveform data item is highlighted. For example, in FIG. 3, an uppermost waveform assignment information item "waveform 1: C1-C1" in the waveform assignment guide area Aw indicates that waveform data indicated by waveform name information "waveform 1" is assigned to a key "C1". As denoted by a symbol "Se1", the uppermost waveform assignment information item is highlighted or emphasized in bold and italic text with hatching to indicate that "waveform 1" is currently selected. The waveform data includes not only data representing waveforms based on sampling or the like but also a waveform parameter set which combines arithmetic parameters for generating desired waveforms.

Displayable waveform assignment information items including the currently selected one are displayed on the waveform assignment display portion. In the display example of FIG. 3, the waveform assignment display portion displays that waveform name information items "waveform 1"~"waveform 4", which include the currently selected one "waveform 1", are assigned to keys C1-D#1, respectively. In this example, specific waveforms are also assigned to 57 keys E1-C6, respectively, although not displayed on the waveform assignment display portion. The waveform assignment information of the entire key range is referred to as an "assignment map".

A key corresponding to the currently selected waveform assignment information item is also highlighted in the keyboard image Kb. For example, when a waveform assignment information item "waveform 1: C1-C1" is selected as in the display example of FIG. 3, the key C1 is highlighted in the keyboard image Kb as denoted by a symbol "Se2". The waveform attribute information display area At is displayed as needed, in which a variety of attribute information (for example, a specific name (nickname), a sampling rate, and the length) of currently selected waveform data is displayed. Namely, in the electronic musical instrument, the display device displays an image Kb of the keyboard where an image of the key C1 directly operated under the waveform direct selection mode is displayed in manner distinct from images of other keys.

Such a waveform assignment state can be selected by selective operation of a specific switch in response to guide display on the operation guide portion. Specifically, a direct guide image, an up guide image, and a down guide image denoted by "DIRECT", "UP (Δ)", and "DOWN (∇)" are displayed in the operation guide portion of the waveform assignment guide area Aw, and these images correspond to adjacent switches having up and down operation indicators "Δ" and "∇" provided below the display device 16. Each of these switches is assigned with the function of a waveform selection button when the waveform editing screen We is displayed on the display device 16.

More specifically, the function of a waveform direct button DRw is assigned to each of two up and down switches "Δ" and "∇" (i.e., a leftmost pair of switches in FIG. 3) provided at positions corresponding to the direct guide image "DIRECT". In addition, the function of a waveform up button UPw is assigned to each of three up switches "Δ" (i.e., 2nd to 4th switches from the left end in a second lowest line in FIG. 3) provided at positions corresponding to the up guide image "UP (Δ)", and the function of a waveform down button DNw is assigned to each of three down switches "∇V" (i.e., 2nd to 4th switches from the left end in a lowest line in FIG. 3) provided at positions corresponding to the down guide image "DOWN (∇)".

For example, each time a user operates the waveform up or down button UPw or DNw, a highlighted waveform assignment information item is scrolled up or down one by one, so that it is possible to find target waveform data by stopping the operation of the button UPw or DNw when the desired waveform assignment information item is highlighted as denoted by "Se1". If the user presses the waveform direct button DRw, a waveform direct selection mode is set. If the user presses a desired one of the keys on the keyboard 14 of the electronic musical instrument in this waveform direct selection mode (for example, while pressing the button DRw), a waveform assignment information item associated with a waveform assigned to the pressed key is immediately or directly highlighted (as denoted by "Se1") in the waveform assignment display portion so that it is possible to find target waveform data.

The start key guide area Ks includes an upper start key display portion and a lower start key selection guide portion, and the end key guide area Ke includes an upper end key display portion and a lower end key selection guide portion. The start key display portion displays start key information representing a start key of a key range to which a currently selected waveform is assigned, and the end key display portion displays end key information representing an end key of the key range. Here, the start key indicates a lowest pitch key at a left end of the key range to which the waveform is assigned, and the end key indicates a highest pitch key at a right end of the key range. In this display example, specific waveform data is individually assigned to each key and each key range is composed of one key so that the highest and lowest pitch keys of the key range are identical, and "waveform 1" is currently selected. Accordingly, both the start and end key display portions display "C1" as shown in FIG. 3.

These start and end keys can be selected by selective operations of specific switches according to guide display on the start and end key selection guide portions. For example, a direct guide image, an up guide image, and a down guide image denoted by "DIRECT", "UP (Δ)", and "DOWN (∇)" are displayed in the start key selection guide portion of the start key guide area Ks, and these images correspond to adjacent switches having up and down operation indicators "Δ" and "∇" provided below the display 16. Each of these switches "Δ" and "∇" is assigned the function of a button for selecting a start key of a key range associated with currently selected waveform data.

Specifically, the function of a start key direct button DRs is assigned to each of two up and down switches "Δ" and "∇" (i.e., a 4th pair of switches from the right end in FIG. 3) corresponding to the direct guide image "DIRECT". In addition, the function of a start key up button UPs is assigned to an up switch "Δ" (i.e., a 3rd switch from the right end in the second lowest line in FIG. 3) at a position corresponding to the up guide image "UP (Δ)", and the function of a start key down button DNs is assigned to a down switch "∇" (i.e., a 3rd switch from the right end in the lowest line in FIG. 3) at a position corresponding to the down guide image "DOWN (∇)".

Accordingly, each time the user operates the start key up or down button UPs or DNs, start keys are scrolled up or down to be displayed one by one in the start key display portion, so that it is possible to determine a target start key by stopping the operation of the button UPs or DNs when the desired start key is displayed. If the user presses the start key direct button DRs, a start key direct selection mode is set. If the user presses a desired one of the keys on the keyboard 14 of the electronic musical instrument in this start key direct selection mode (for example, while pressing the button DRs), it is possible to immediately or directly select and determine the pressed key as a target start key.

In order to select an end key of the key range associated with the currently selected waveform data, corresponding buttons are also assigned to switches for the end key selection guide portion of the end key guide area Ke in the same manner as described above. Specifically, the function of an end key direct button DRe is assigned to each of two up and down switches "Δ" and "∇" (i.e., a 2nd pair of switches from the right end in FIG. 3) corresponding to the direct guide image "DIRECT" in the same manner as described above. In addition, the function of an end key up button UPe is assigned to an up switch "Δ" (i.e., a rightmost switch in the second lowest line in FIG. 3) at a position corresponding to the up guide image "UP (Δ)", and the function of an end key down button DNe is assigned to a down switch "∇" (i.e., a rightmost switch in the lowest line in FIG. 3) at a position corresponding to the down guide image "DOWN (∇) ".

Accordingly, each time the user operates the end key up or down button UPe or DNe, end keys are scrolled up or down to be displayed one by one in the end key display portion, so that it is possible to determine a target end key by stopping the operation of the button UPe or DNe when the desired end key is displayed. If the user presses the end key direct button DRe, an end key direct selection mode is set. If the user presses a desired one of the keys on the keyboard 14 of the electronic musical instrument in this end key direct selection mode (for example, while pressing the button DRe), it is possible to immediately or directly select and determine the pressed key as an end key of the selected waveform key range. Namely, the inventive electronic musical instrument can assign the waveform data to a range of keys arranged from a start key to an end key by directly operating the start key and the end key.

If the waveform direct button DRw, start key direct button DRs, or end key direct button DRe is activated (i.e., turned on), a corresponding direct selection mode is set, and if the button is deactivated (i.e., turned off), the mode is switched to the original non-selection mode. For example, if the button DRw, DRs, or DRe is activated, the waveform selection mode, the start key selection mode, or the end key selection mode is set. When a key is operated, a waveform, a start key, or an end key corresponding to the operated key is selected until the button is deactivated (i.e., while the button is pressed). In addition, it is possible to return to the original mode by deactivating the button DRw, DRs, or DRe. The mode may also be switched between the selection and non-selection modes each time the button is operated.

Using the waveform editing screen We, the user can add and delete waveform data and save setting states of waveform data. Accordingly, the add operation guide image Ad, the delete operation guide image Dt, and the save operation guide image Sv are displayed in association with three adjacent switches "A", "B", and "C" at the right side in FIG. 3. With the waveform editing screen We displayed on the display 16, the three switches "A" to "C" are assigned with the function of an add button BA to indicate addition of waveform data, the function of a delete button BB to indicate deletion of waveform data, and the function of a save button BC to indicate saving of waveform data setting states obtained using this waveform editing screen We, respectively.

A brief overview of the waveform assignment function of the electronic musical instrument according to the present invention is described below with reference to FIG. 3. In this electronic musical instrument, when a waveform assignment process is performed, the waveform editing screen We is displayed on the display 16, and the state of assignment of waveform data to the keyboard 14 is displayed on the waveform assignment display portion of the waveform assignment guide area Aw. Up and down operation switches "Δ" and "∇" shown at the lower left end of FIG. 3 function as waveform direct switches DRw which permit setting of the waveform direct selection mode. When the user operates the waveform direct switches DRw, a waveform direct selection mode is set in response to the operation. When the user operates a key of the keyboard 14 in this waveform selection mode, a waveform assignment state of waveform data assigned to the operated key is highlighted as denoted by "Se1" to inform the user that the waveform data has been selected. The assignment state of the selected waveform data can be edited on the waveform editing screen We.

[Waveform Assignment Process Flow]

Figure 4:
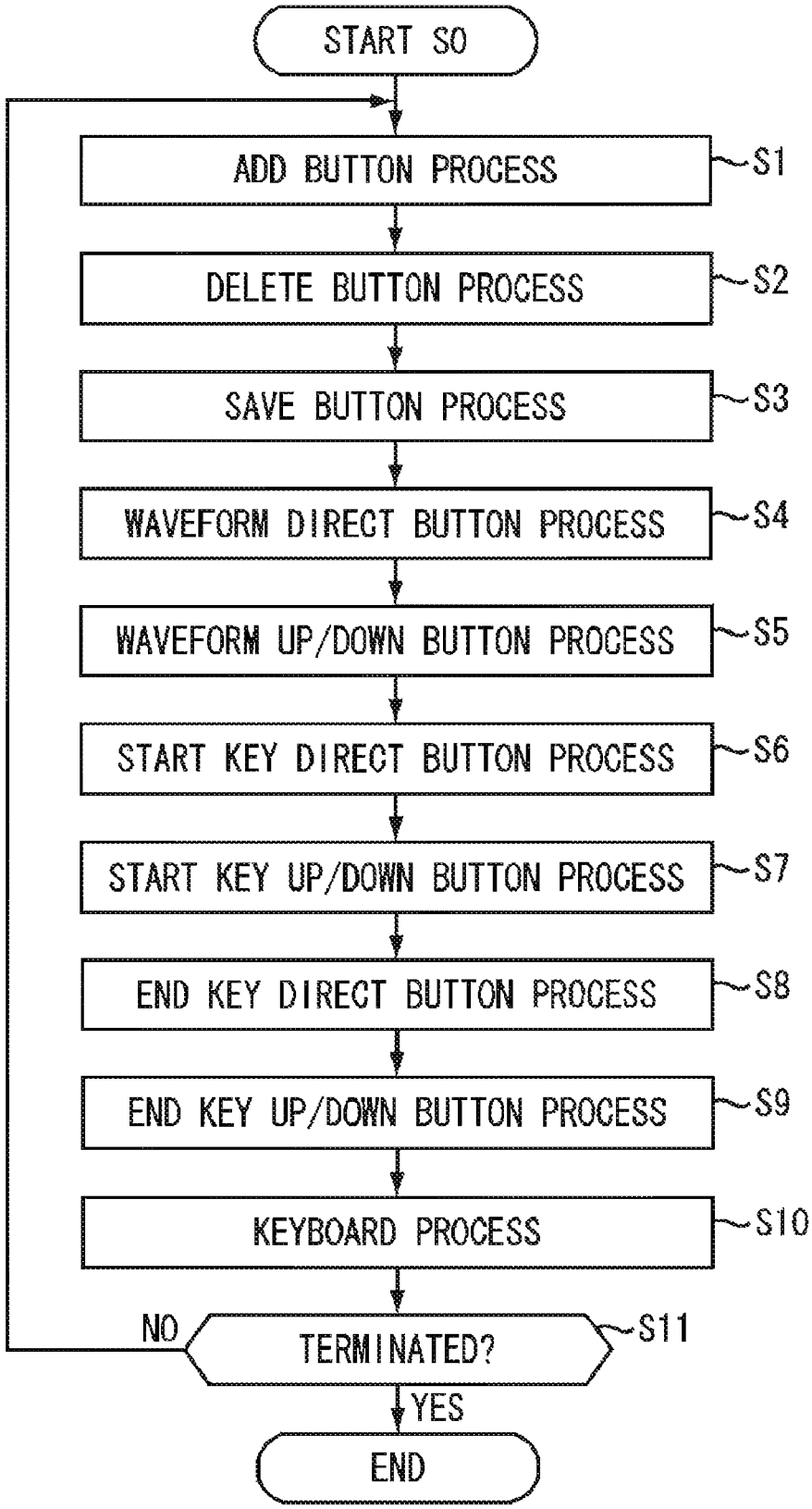
FIG. 4 is a flow chart of a waveform assignment procedure in an electronic musical instrument according to an embodiment of the present invention.

Waveform data assigned to a key range including one or more keys of a keyboard can be easily selected according to a waveform assignment program in an embodiment of the present invention. FIG. 4 is a flow chart of an example of a waveform assignment process performed in the electronic musical instrument according to the embodiment of the present invention.

When the process flow is started at step S0, the CPU 1 first displays a waveform editing screen We, and allows switches around the screen We to function as waveform direct, up, and down buttons DRw, UPw, and DNw, start and end key direct, up, and down buttons DRs, DRe, UPs, UPe, DNs, and DNe, and add, delete, and save buttons BA, BB, and BC as shown in FIG. 3.

The CPU 1 performs an add button process at step S1 if the user operates the add button BA, and skips this process if the add button BA is not operated. In the add button process, the CPU 1 displays a waveform add screen (not shown) on the display 16 in response to the operation of the add button BA, then designates waveform data to be added in response to a designation operation by the user, and sets a start key of a key range of the waveform data in response to a corresponding operation by the user. An end key of the key range may be set by the user in the same manner and may also be automatically set according to a predetermined rule. The CPU 1 adds the designated waveform data to voice (tone) data in response to an add confirmation operation by the user, and incorporates the setting state of the designated waveform data into the waveform assignment information, and then returns to the waveform editing screen We.

The CPU 1 performs a delete button process at step S2 if the user operates the delete button BB, and skips this process if the delete button BB is not operated. In the delete button process, in response to operation of the delete button BB, the CPU 1 deletes a currently selected waveform data item, which is highlighted in the waveform assignment display portion of the waveform assignment guide area Aw in the waveform editing screen We, from the voice (tone) data, and then removes the setting state of the deleted waveform data from the waveform assignment information.

The CPU 1 performs a save button process at step S3 if the user operates the save button BC, and skips this process if the save button BC is not operated. In the save button process, in response to operation of the save button BC, the CPU 1 saves, as voice (tone) data, the assignment setting state of the current waveform data item in the waveform editing screen We. For example, the assignment setting state is saved as voice data of a drum tone if drum sound waveform assignment has been edited, or it is saved as voice data of a first piano tone if first piano sound waveform assignment has been edited.

The CPU 1 performs a waveform direct button process at step S4 if the user operates the waveform direct button DRw, and skips this process if the waveform direct button DRw is not operated. In the waveform direct button process, if the waveform direct button DRw is activated (i.e., turned on), the keyboard 14 is set to a waveform selection mode. If the waveform direct button DRw is deactivated (turned off), the keyboard 14 returns to the original (normal) mode.

The CPU 1 performs a waveform up/down button process at step S5 if the user operates (turns on) the waveform up button UPw or the waveform down button DNw, and skips this process if the waveform up or down button UPw or DNw is not operated. In the waveform up/down button process, the CPU 1 changes the selected waveform data one item up or down in response to each operation of the waveform up or down button UPw or DNw. In this case, the CPU 1 scrolls the display of the waveform assignment display portion if a change is made to a waveform data item not displayed on the waveform assignment display portion in the waveform assignment guide area Aw. A range from a start key to an end key of the selected waveform data item is displayed by an image, text, or a number in combination with the selected waveform data item on the waveform assignment display portion.

The CPU 1 performs a start key direct button process at step S6 if the user operates the start key direct button DRs, and skips this process if the start key direct button DRs is not operated. In the start key direct button process, if the start key direct button DRs is activated (turned on), the keyboard 14 is set to a start key selection mode. If the start key direct button DRs is deactivated (turned off), the keyboard 14 returns to the original (normal) mode.

The CPU 1 performs a start key up/down button process at step S7 if the user operates (turns on) the start key up button UPs or the start key down button DNs, and skips this process if the start key up or down button UPs or DNs is not operated. In the start key up/down button process, the CPU 1 changes the currently set start key of the currently selected waveform data item one key up or down in response to each operation of the start key up or down button UPs or DNs, and modifies start key information of the corresponding waveform assignment information. Accordingly, the CPU 1 updates a start key display on the start key display portion in the start key guide area Ks and also updates a start-to-end key range display on the waveform assignment display portion in the waveform assignment guide area Aw. However, the start key of the key range cannot be set to overlap with previously set start-to-end key ranges of other waveform data. In addition, the pitch of the start key of the corresponding waveform is limited to less than or equal to the pitch of the end key.

The CPU 1 performs an end key direct button process at step S8 if the user operates the end key direct button DRe, and skips this process if the end key direct button DRe is not operated. In the end key direct button process, if the end key direct button DRe is activated (turned on), the keyboard 14 is set to an end key selection mode. If the end key direct button DRe is deactivated (turned off), the keyboard 14 returns to the original (normal) mode.

The CPU 1 performs an end key up/down button process at step S9 if the user operates (turns on) the end key up button UPe or the end key down button DNe, and skips this process if the end key up or down button UPe or DNe is not operated. In the end key up/down button process, the CPU 1 changes the currently set end key of the currently selected waveform data item one key up or down in response to each operation of the end key up or down button UPe or DNe, and modifies end key information of the corresponding waveform assignment information. Accordingly, the CPU 1 updates an end key display on the end key display portion in the end key guide area Ke and also updates a start-to-end key range display on the waveform assignment display portion in the waveform assignment guide area Aw. However, the end key of the key range cannot be set to overlap with previously set start-to-end key ranges of other waveform data. In addition, the pitch of the end key of the corresponding waveform is limited to higher than or equal to the pitch of the start key.

The CPU 1 performs a keyboard process at step S10 if the user operates the keyboard 14, and skips this process if the keyboard 14 is not operated. In the keyboard process, if a key is activated (i.e., pressed) in normal mode, music based on waveform data assigned to the activated key is sounded, whereby the user can check the assignment state of the waveform data via the generated music sound. If the key is deactivated (i.e., released), the music is silenced. In other modes (i.e., in a waveform selection mode, a start key selection mode, or an end key selection mode), the keyboard process of step S10 is performed in the following manner.

In the waveform selection mode, if a key is operated, waveform data assigned to the operated key is selected with reference to the assignment map, and a range from a start key to an end key of the selected waveform data is displayed on the assignment editing screen We. Here, no process is performed if no waveform has been assigned to the operated key. In the start or end key selection mode, a selected key is set to a start or end key of the currently selected waveform data, and a start-to-end key range display on the waveform assignment display portion in the waveform assignment guide area Aw is updated accordingly. However, as described above, the start or end key of the key range cannot be set to overlap with previously set start-to-end key ranges of other waveform data, and the pitch of the start key of the corresponding waveform is limited to less than or equal to the pitch of the end key (i.e., pitch of start key≦pitch of end key).

At step S11, it is determined whether or not an "EXIT" button (not shown) has been operated. While the "EXIT" button is not operated (S11→NO), the CPU 1 returns to step S1. Then, in response to the variety of operations by the user described above, corresponding ones of the processes of steps S1-S10 are repeated. When it is determined that the "EXIT" button has been operated (i.e., the procedure is to be terminated) (S11→YES), this waveform assignment procedure is terminated. The present invention may also be embodied such that, when the procedure is terminated, the user is asked whether to save the setting state if the setting state has not been saved.

As is apparent from the above description, according to the present invention, if a key of the keyboard is operated in the waveform selection mode, waveform data assigned to the operated key is selected, so that target waveform data assigned to each key of the keyboard can be easily selected as an assignment editing target. In addition to easy operation to select a waveform assigned to the keyboard, it is possible to perform editing of the assignment state of the currently selected waveform data, such as modification of the assignment state or removal thereof from allocation targets.

Although the preferred embodiments of the present invention have been disclosed with reference to the drawings for illustrative purposes, those skilled in the art will appreciate that various modifications, additions and substitutions are possible, without departing from the scope and spirit of the invention as disclosed in the accompanying claims. For example, it is possible to take into account a preset "transpose" value when performing direct selection based on operation of a direct button DRw, DRs, or DRe. For example, if a key "C3" is operated when a transpose value of +12 (i.e., one octave up) has been set, it is read as "C4" instead of "C3", and a waveform, a start key, or an end key is selected accordingly.

Processes other than assignment map data setting or deletion (for example, setting of start and end keys) can also be performed for waveform data selected by the direct selection operation (DRw+key). For example, editing of the contents of the waveform data such as editing of the name, sampling rate, and length of the waveform data or processing of the waveform data in a filter or the like can be performed.

Not only the switch around the display to which the direct button function is assigned but also a dedicated switch mounted on the electronic musical instrument may be used as the operator for setting the waveform selection mode.

What is claimed is:

1. An electronic musical instrument comprising:

a keyboard having a plurality of keys which are operable to generate tones and which can be assigned with waveform data which is voice data representing the tones generated by the keyboard;

a display section that displays an assignment state of the waveform data to the keys of the keyboard;

an operating section that is operable to input a mode setting operation in correspondence to the display of the assignment state of the waveform data;

a mode setting section that sets a waveform direct selection mode in response to the mode setting operation of the operating section;

a waveform selection section that selects waveform data assigned to at least one key of the keyboard as an assignment editing target, in response to direct operation of said one key of the keyboard under the waveform direct selection mode, and that enables editing of the assignment state of the waveform data assigned to said one key; and an editing section that can be operated to conduct the editing of the assignment state of the waveform data, wherein the editing section can assign the waveform data to a range of keys arranged from a start key to an end key by directly operating the start key and the end key, and wherein the editing section cannot assign other waveform data by directly operating a start key or an end key in overlap manner to the range of the keys which are already assigned with the waveform data by means of the start key and the end key.

2. The electronic musical instrument according to claim 1, wherein the display section displays the assignment state of the waveform data including waveform name information indicating the waveform data and key range information indicating a range of keys to which the waveform data is assigned.

3. The electronic musical instrument according to claim 1, wherein the display section further displays an image of the keyboard where an image of the key directly operated under the waveform direct selection mode is displayed in manner distinct from images of other keys.

4. The electronic musical instrument according to claim 1, wherein the editing section conducts the editing of the assignment state of the selected waveform data, the editing including changing of the assignment of the selected waveform data and canceling of the assignment of the selected waveform data.

5. A machine readable medium containing a waveform assignment program for use in an electronic musical instrument including a processor and a keyboard having a plurality of keys which are operable to generate tones and which can be assigned with waveform data which is voice data representing the tones generated by the keyboard, the program being executable by the processor to cause the electronic musical instrument to perform a method comprising:

displaying a waveform assignment screen indicating an assignment state of the waveform data to the keys of the keyboard;

inputting a mode setting operation in correspondence to the display of the assignment state of the waveform data;

setting a waveform direct selection mode in response to the mode setting operation;

selecting waveform data assigned to at least one key of the keyboard as an assignment editing target, in response to the direct operation of said one key of the keyboard under the waveform direct selection mode; and enabling editing of the assignment state of the selected waveform data assigned to said one key; and conducting the editing of the assignment state of the waveform data, such that the waveform data can be assigned to a range of keys arranged from a start key to an end key by directly operating the start key and the end key, and other waveform data cannot be assigned by directly operating a start key or an end key in overlap manner to the range of the keys which are already assigned with the waveform data by means of the start key and the end key.

* * * * *